US005653343A

United States Patent [19]

Imai

[11] Patent Number: 5,653,343

[45] Date of Patent: Aug. 5, 1997

[54] CONTAINER FOR AN ELECTRIC TOOTHBRUSH

[75] Inventor: Kiyoshi Imai, Toyama, Japan

[73] Assignees: Kitano Co., Ltd., Toyama-Pref; Japan CBM Corporation, Tokyo, both of Japan

[21] Appl. No.: 518,844

[22] Filed: Aug. 24, 1995

[30] Foreign Application Priority Data

Aug. 31, 1994 [JP] Japan ..... 6-012387

[51] Int. Cl.[6] ..... B65D 69/00; A63H 27/00

[52] U.S. Cl. ..... 206/581; 206/15.2; 206/209; 132/311; 132/316; 220/23.8

[58] Field of Search ..... 206/301, 207, 206/209, 209.1, 362, 15.2, 581; 220/23.8, 23.82, 23.2, 500, 501; 132/308, 311, 312, 313, 314, 316

[56] References Cited

U.S. PATENT DOCUMENTS

| | | | |
|---|---|---|---|
| 1,184,048 | 5/1916 | Tillman | 206/209 |
| 3,059,802 | 10/1962 | Mitchell | 220/501 |
| 3,685,717 | 8/1972 | Seiferth et al. | 220/23.8 |
| 3,881,868 | 5/1975 | Duke | 206/209.1 |
| 4,121,600 | 10/1978 | Riddick et al. | 206/581 |
| 4,344,535 | 8/1982 | Cagnazzi | 206/581 |
| 4,768,530 | 9/1988 | Vaughn | 206/581 |
| 4,961,717 | 10/1990 | Hickey | 206/15.2 |

*Primary Examiner*—Paul T. Sewell
*Assistant Examiner*—Luan K. Bui
*Attorney, Agent, or Firm*—Dennison, Meserole, Pollack & Scheiner

[57] ABSTRACT

An electric toothbrush housed in a container has a cylindrical case body, a brush attached to the case body, and a battery mounted in the case body for operating the motor to vibrate the brush, and a switch provided on the case body for operating a motor to vibrate the brush. The container has a base container body and a lid engaged with the base container body. The base container body has a large diameter cylindrical portion for housing the case body, and a small diameter cylindrical portion for housing the brush and the battery. The lid is provided to form a cup.

3 Claims, 4 Drawing Sheets

CONTAINER FOR AN ELECTRIC TOOTHBRUSH

BACKGROUND OF THE INVENTION

The present invention relates to an electric toothbrush, and more particularly to a portable container for the electric toothbrush.

A conventional container for an electric toothbrush comprises a tray made of synthetic resin having recessed portions and housed in a transparent box. The electric toothbrush comprises a case body, a battery and a brush. Each of the parts is engaged in the corresponding recessed portion of the tray in the horizontal position.

When using the toothbrush outside the home, such as office or school, there is a case where no cup is provided. In such a case, the user must receive water with the user's hands in order to rinse the mouth. This is undesirable for the user.

SUMMARY OF THE INVENTION

An object of the present invention is to provide a portable container for an electric toothbrush where the container can be used as a cup.

According to the present invention, there is provided a container for an electric toothbrush having a cylindrical case body, a motor provided in the case body, a brush attached to the case body, a battery mounted in the case body for operating the motor to vibrate the brush, and a switch provided on the case body for operating the motor.

The container comprises a base container body having an upper opening, a lid engaged with the base container body to close the upper opening, the base container body having a large diameter cylindrical portion for housing the case body, and a small diameter cylindrical portion for housing the brush and the battery.

The lid being provided to form a cup. The lid has a shape similar to that of the base container body.

Opposite flat connecting portions are formed between the large diameter cylindrical portion and the small diameter cylindrical portion. A switch button provided on the case body is inserted between the flat connecting portions 'so as to be held by the flat connecting portions.

These and other objects and features of the present invention will become more apparent from the following detailed description with reference to the accompanying drawings.

DETAILED DESCRIPTION OF THE PREFERRED EMBODIMENT

Figure 1:
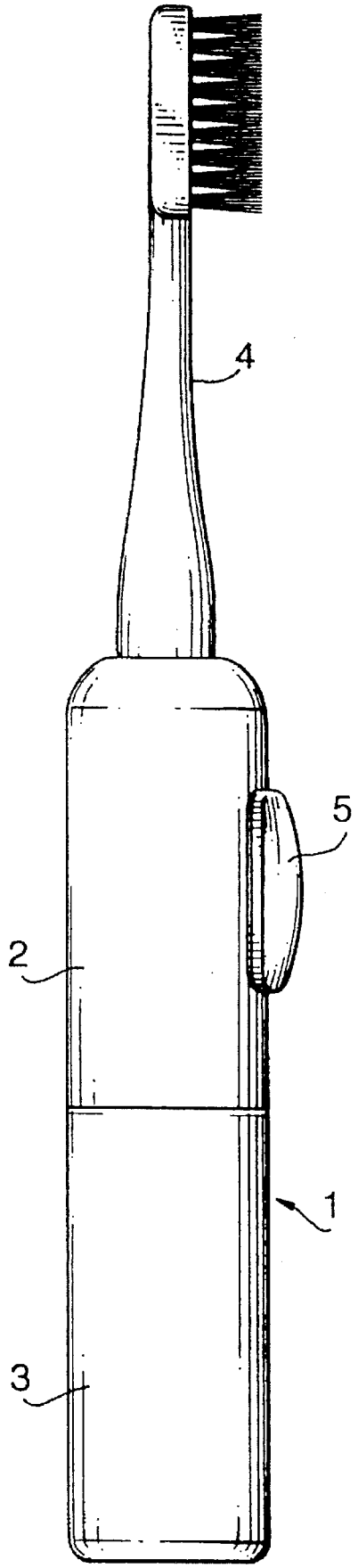
FIG. 1 is a side view showing an electric toothbrush used in the present invention.
Figure 2:
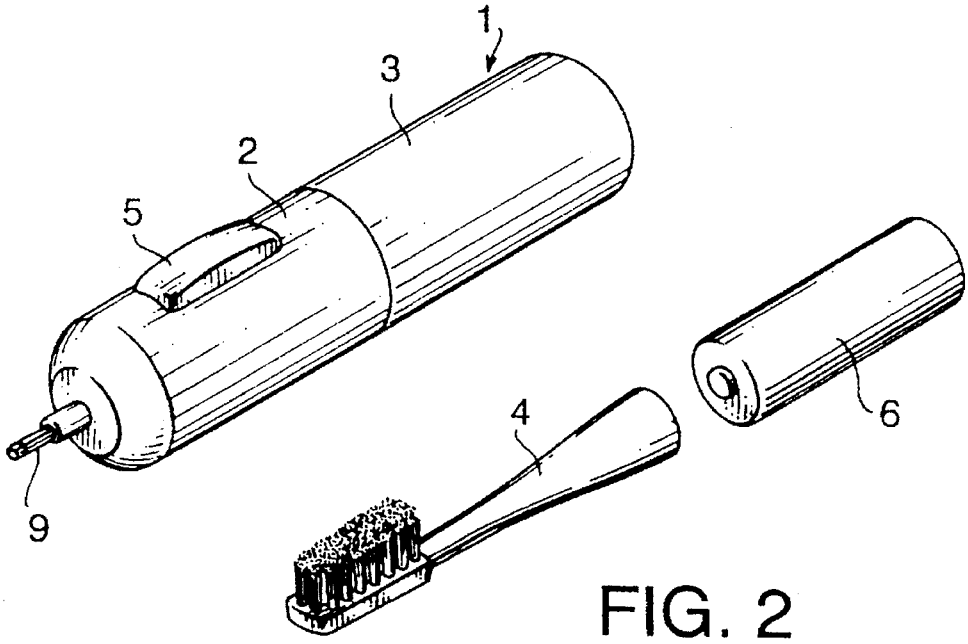
FIG. 2 is an exploded perspective view showing the electric toothbrush.

Referring to FIGS. 1 and 2, an electric toothbrush comprises a cylindrical case body 1 comprised of a front case 2 and a rear case 3 as a handle, and a brush 4 attached to the front case 2. An on-off switch button 5 is provided on the front case 2. A motor is mounted in the front case 2. The motor has an eccentric weight secured to a rotating shaft thereof for vibrating the brush 4. A battery 6 is housed in the rear case 3. A connecting shaft 9 is forwardly projected from the front end of the front case 2. The brush 4 has an axial hole engaged with the connecting shaft 9 so as to be connected to the front case.

Figure 3:
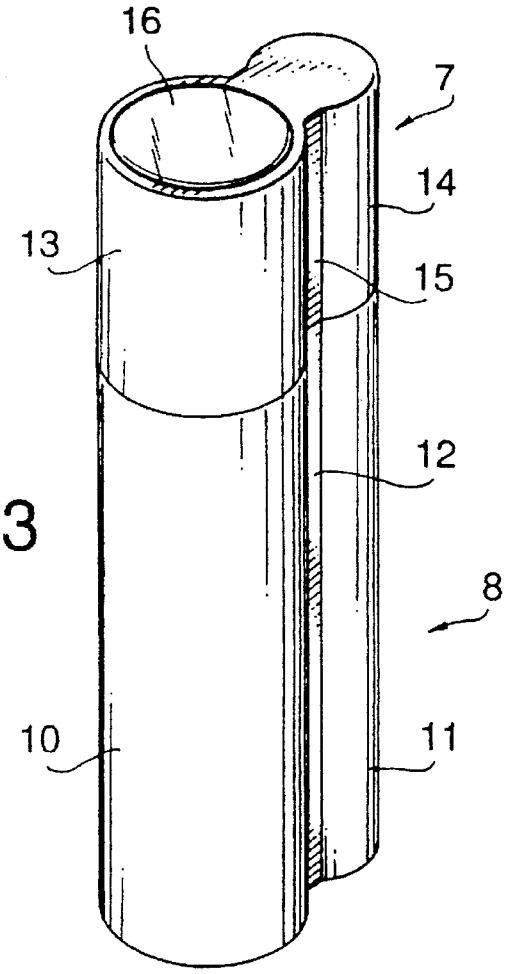
FIG. 3 is a perspective view showing a container for the electric toothbrush according to the present invention.

Referring to FIG. 3 showing a container for the electric toothbrush according to the present invention, the container is made of plastic and comprises a base container body 8 having a bottom and an upper opening, and an upper lid 7 engaged with the base container body. The lid 7 has the same configuration as the base container body 8 as viewed in plain.

Figure 4:
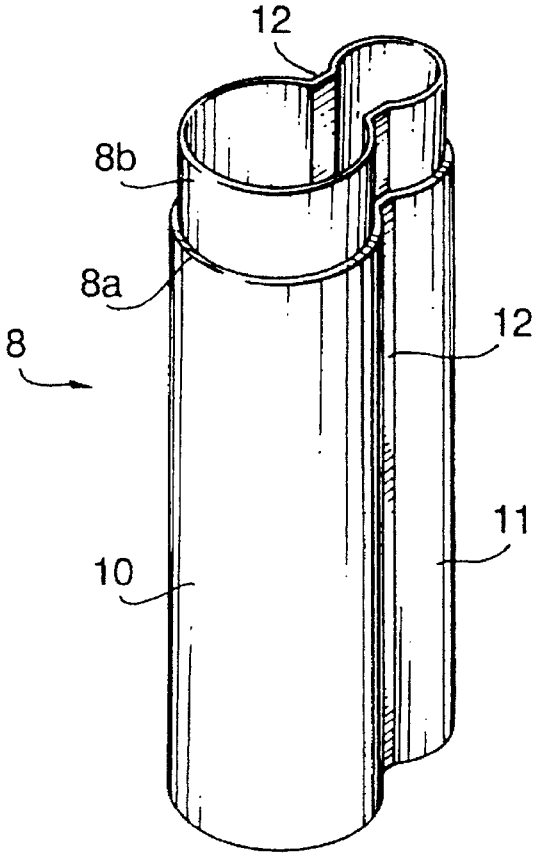
FIG. 4 is a perspective view showing a base body of the container.

Referring to FIG. 4, the base container body 8 has a large diameter cylindrical portion 10, a small diameter cylindrical portion 11, and flat connecting wall portions 12 formed opposite to each other between the large diameter cylindrical portion 10 and the small diameter cylindrical portion 11 to form a full-height radial chamber between the cylindrical portions.

Furthermore, the base container body 8 has an outer shoulder portion **8*a* formed around the base container body so as to form a thinner engaging portion 8*b*** at an upper portion thereof.

Figure 5:
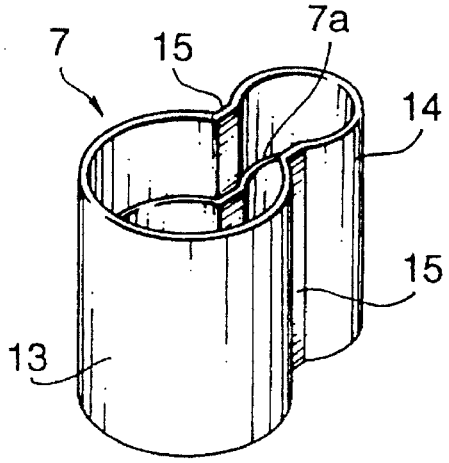
FIG. 5 is a perspective view showing a lid of the container.

Referring to FIG. 5, the upper lid 7 has a large diameter cylindrical portion 13, a small diameter cylindrical portion 14, and flat connecting portions 15 formed opposite to each other between the large diameter cylindrical portion 13 and the small diameter cylindrical portion 14. These portions of the lid 7 are formed corresponding to those of the base container body 8.

The lid 7 has an inner shoulder portion **7*a* so as to form a thinner engaging portion 7*b* corresponding to the thinner engaging portion 8*b* of the base container body 8**.

Referring to FIG. 3, a mirror 16 is attached to the outside end wall of the large diameter cylindrical portion 13 of the lid 7.

Figure 6:
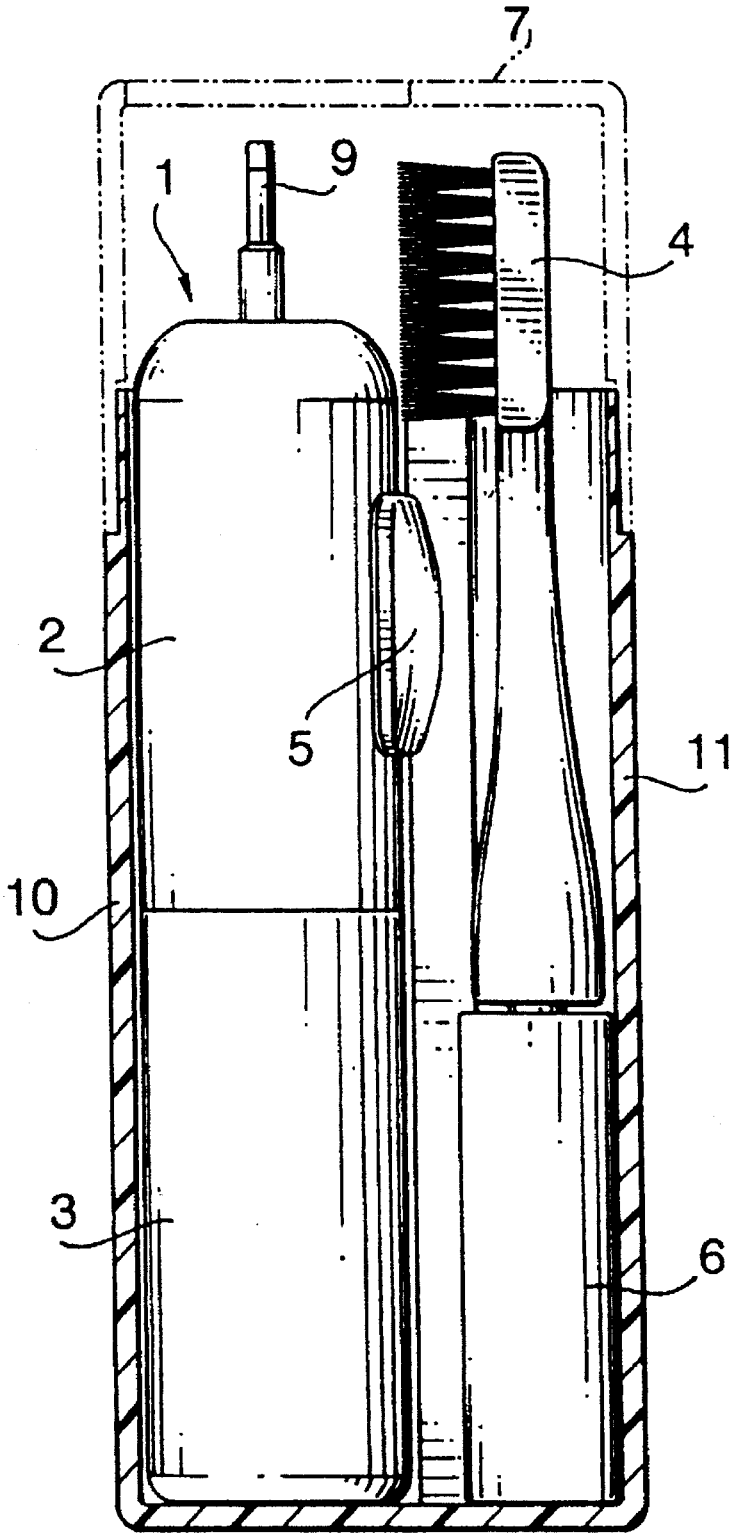
FIG. 6 is a sectional view showing a housing condition of the container.

In the container, the case body 1 is housed in the large diameter cylindrical portion 10 of the base container body 8, and the battery 6 and the brush 4 are housed in the small diameter cylindrical portion 11 in order as shown in FIG. 6. The case body 1 can be inserted in the large diameter cylindrical portion 10 only in the position shown in FIG. 6, since the switch button 5 can be inserted only at the position between the flat connecting portions 12. At the position, the switch button 5 is held by the flat connecting portions 12, so that the case body 1 is held without rotating.

The thinner engaging portions **7*b* and 8*b* of the lid 7 and the base container body 8** are engaged with each other so that the outer configurations thereof are coplanar with each other.

When the electric toothbrush is used, the case body 1, brush 4 and battery 6 are removed from the base container body 8. As shown in FIG. 1, the battery 6 is mounted in the rear case 3 of the case body 1, and the brush 4 is attached to the front case 2. The on-off switch button 5 is slid to turn on the switch. The motor is driven to vibrate the brush 4.

After brushing the teeth, the lid 7, having a capacity sufficient to be used as a cup, is filled with water. The opposite flat connecting portions 15 are provided to be grasped by the fingers. Thus, the mouth can be rinsed with water in the lid 7.

In accordance with the present invention, the portable container has a lid used as a cup. Thus, the toothbrush is easily and conveniently used at everywhere.

While the invention has been described in conjunction with preferred specific embodiment thereof, it will be understood that this description is intended to illustrate and not limit the scope of the invention, which is defined by the following claims.

What is claimed is:

1. A portable electric toothbrush kit comprising a disassembled toothbrush, a container receiving said disassembled toothbrush, and a drinking vessel formed as a component of said container;

said electric toothbrush having a cylindrical case body, a motor provided in the case body, a brush detachably attached to the case body, a battery removably mounted in the case body for operating the motor to vibrate the brush, and a switch button on and projecting from the case body for operating the motor;

said container comprising a vertically elongate base container body having an upper opening, said base container body being defined by a full height large diameter cylindrical portion housing the cylindrical case body, a laterally adjacent full height small diameter cylindrical portion separately housing the brush and the battery disassembled from the case body, and a full height intermediate chamber extending radially between and communicating said cylindrical portions, said intermediate chamber being formed by spaced opposite flat connecting wall portions extending between the large diameter cylindrical portion and the small diameter cylindrical portion on opposed sides of the base container body, the distance between the flat connecting wall portions being smaller than the diameter of the small diameter cylindrical portion, wherein said base container body has, in horizontal cross section, a narrow, central, substantially rectangular section between two substantially circular sections, said projecting switch button on said case body extending radially beyond said large diameter cylindrical portion and into said intermediate chamber for retention by and between said flat wall portions;

said drinking vessel comprising a detachable and replaceable lid having a same sectional shape as the base container body and comprising a large diameter cylindrical portion and a small diameter cylindrical portion;

said lid engaging said base container body by overlapping friction engagement to close the upper opening;

said lid having a hollow interior for use of said lid as a drinking vessel upon detachment from said base container body.

2. The toothbrush kit of claim 1 wherein said lid includes a narrow substantially rectangular section between said large diameter cylindrical portion and said small diameter cylindrical portion of said lid wherein recessed portions are defined for a grasping of said lid by fingers engaged in said recessed portions for facilitating use of said lid as a drinking vessel.

3. The toothbrush kit of claim 2 wherein said lid includes a top end wall, and a mirror attached to a portion of said top end wall over said large diameter cylindrical portion of said lid.

* * * * *